United States Patent [19]

Viessmann

[11] 4,109,614

[45] Aug. 29, 1978

[54] BOILER FOR THE COMBUSTION OF LIQUID OR GASEOUS FUELS

[76] Inventor: Hans Viessmann, Im Hain, 3559 Battenberg, Eder, Fed. Rep. of Germany

[21] Appl. No.: 781,642

[22] Filed: Mar. 28, 1977

[30] Foreign Application Priority Data

Mar. 27, 1976 [DE] Fed. Rep. of Germany ..... 2613186

[51] Int. Cl.[2] ..... F22B 7/12

[52] U.S. Cl. ..... 122/149; 165/154; 122/367 C

[58] Field of Search ..... 122/136 R, 136 C, 149, 122/367 R, 367 C; 165/143, 152, 154

[56] References Cited

U.S. PATENT DOCUMENTS

| | | | |
|---|---|---|---|
| 2,123,444 | 7/1938 | Thibaudeau | 122/149 |
| 2,751,200 | 6/1956 | Peters | 165/143 |
| 2,970,812 | 2/1961 | Kritzer | 165/152 |
| 3,016,893 | 1/1962 | Brown, Jr. | 165/154 |
| 3,120,838 | 2/1964 | Mueller | 122/149 |

*Primary Examiner*—Kenneth W. Sprague
*Attorney, Agent, or Firm*—Kurt Kelman

[57] ABSTRACT

A boiler for the combustion of liquid or gaseous fuels comprises a water-carrying housing in which is provided a cylindrical chamber for receiving the combustion chamber and the fuel gas flues, with a reversion chamber coupled ahead thereof, and with the chamber being surrounded by a plurality of circumferentially distributed flue channels disposed in spaced and side-by-side relationship and in cross section formed by approximately U-shaped sheet metal profiles, which channels are in communication with a flue gas collecting chamber provided with a flue gas discharge and are connected by longitudinal welding seams to the inner wall of the cylindrical chamber.

9 Claims, 9 Drawing Figures

BOILER FOR THE COMBUSTION OF LIQUID OR GASEOUS FUELS

BACKGROUND OF THE INVENTION

The present invention relates to improvements in boilers of the type known, for example, from Swiss Pat. No. 485,182 and German Pat. No. 1,778,880. Although these boilers meet the requirements placed upon them as regards the possible heat utilization, the practical realization and an economical manufacture present considerable problems for which reason these boilers in all probability will not be commercially accepted. In this connection, the embodiments of the systems according to the patents in which U-shaped or approximately U-shaped sheet metal profiles are mounted on a cylindrical surface on the inner wall thereof and the profiles are welded together along the leg edges thereof, are of a special interest. Conversely, such boilers are unsuitable for use without difficulties over wide temperature ranges, especially low temperature ranges of, for example, between 30° and 60° C, on account of the risk of corrosion involved therewith.

In case of an excessive subdivision of the all-over discharge cross section, a high welding expenditure arises, involving the difficulty of no longer having adequate space between the sheet metal profiles for the welding tools; conversely, the basic regions of the U-profiles directed against the actual combustion chamber become so constricted, partly even pointed, that extremely unfavorable heat transfer conditions would arise if a protective combustion chamber sleeve were to be used on account of the scaling risk of the profiles. If, conversely, correspondingly large interspaces are provided to permit access to mechanical welding tools which nowadays offer the only alternative for an economical manufacture, the all-over discharge cross section is not sufficiently divided and the absorbed heat amounts can no longer be adequately discharged through the material webs. This would result in high exhaust gas temperatures and a scaling risk, the latter especially in the absence of a special combustion chamber sleeve, as is the case with the above-discussed and prior known embodiments.

Although the conception of such a formation of the fuel gas flues with the boilers of the afore-mentioned type in principle is a good one, these boilers do not satisfy the need for an economical and practical possibility of manufacture, for a long operating life and for optimum heat transfer conditions and a favorable corrosion behavior.

SUMMARY OF THE INVENTION

Accordingly, basic to the invention is the problem of improving boilers of the prior known and afore-mentioned type that the above requirements may be optimally realized, i.e. it is an object of this invention to provide a boiler which to a high degree can readily be produced mechanically, which satisfies both with a cooled and an uncooled combustion chamber sleeve the functional heat transfer requirements and which, on account of the domination of the condensate arising in predetermined operational phases, can also be used in low temperature ranges.

This problem is solved with a boiler according to the invention in that the longitudinal edges of the sheet metal profiles to be welded also externally are slightly angularly formed, and that the base regions of the sheet metal profiles by enlarging their original width are compressed toward the internal wall and in height are so compressed that the distance of two profile bases facing one another on a chamber diameter approximately corresponds to the outer diameter of a water-cooled or uncooled combustion chamber sleeve located in the ramaining free space of the chamber, with elements for the rapid evaporization of the condensate being disposed in the area of the regions of the flues, in which the condensate arises.

Accordingly, the U-profiles at the open side thereof, where they are welded, have the required width. Toward the combustion chamber sleeve they are first relatively constricted in order that there be a larger space from the next profile and the mechanical welding burner under the required angle of inclination can weld the fillet seams.

After all the U-profiles having been welded, the sheet metal which, subsequently rounded, forms the cylindrical chamber, will be placed under a press. The U-profiles will be compressed and through the compression tool, with which the compression operation is performed, the U-profiles will have at the base regions thereof a substantially greater width. The free space between the U-profiles after the compression operation in the base area is correspondingly smaller and the base area of the U-profile directed against the combustion chamber wall is almost doubled.

In case of an uncooled pan-type combustion chamber (for use with boilers of a minor capacity) which is merely inserted and easily removable for purging purposes and made of high-grade steel, this is advantageous inasmuch as the faces of the combustion chamber sleeve contacted by the discharging fuel and flue gases are correspondingly reduced by the enlargement of the basic web so that the heat absorption from the very hot combustion chamber wall is correspondingly reduced by the discharging gases.

If the water-carrying combustion chamber is rigidly mounted, which is the case with high-capacity boilers, the firmly abutting base webs present correspondingly large heat transfer faces through which the heat can be well discharged.

As the flues of relatively thin sheet metal webs are very quickly heated up, the corrosion problem in this area is also solved as a corroding condensate liquid can never pass down to the lower flue area and collect there but rather vaporizes at the flue profiles heated up relatively quickly.

To improve the heat transfer from the U-profile to the chamber wall and to avoid at the same time a disadvantageous effect due to compression of the U-profiles after welding on the welding seams—notch cracks must not arise—the lateral legs of the U-profiles at the edges with which they are welded onto the inner surface over a width of about 5 to 6 mm externally are formed angularly. This will allow the introduction of the welding heads (three to four welding electrodes, as a rule, are combined in one tool) at a lower inclination angle to the normal axis for welding purposes. The distance of the originally mounted U-profiles from one another can thereby reasonably be reduced. The welding burner can, therefore, be more steeply introduced and largely melts the previously bent edges of the U-profiles, and a seam of a large cross section and a relatively large width arises whereby, on the one hand, the heat transfer from the U-profile to the internal wall as compared with a simple fillet weld is considerably increased; on the other hand, the seam inwardly toward the U-profile is so strongly welded that, during repressing of the profiles, notch cracks at the welding seam cannot arise from the inner side of the profiles.

The construction according to the invention, on the one hand, thus takes into account the functional requirements as regards the manufacture in that first adequate space is left between the profiles in order to permit a mechanical welding while, on the other hand, due to the compressive process at the profiles, the base face is enlarged.

The boiler preferably is so formed that the sheet metal and U-profiles, respectively, are mounted on the evenly flattened wall, welded thereto and compressed therewith, which wall is bent to form a cylinder and is sealed by a longitudinal welding seam, with the basic regions following the curvature of the combustion chamber wall being compressed in a correspondingly curved manner.

A condensate formation in the boiler during the starting phase and during use of the boiler in lower temperature ranges principally cannot be avoided, which, hitherto, has been taken into account in that the boiler was maintained at a predetermined minimum temperature, for example by return flow admixture and frequent starting of the burner involving a corresponding energy waste, i.e. a boiler operation below the temperatures nowadays customary hitherto has been avoided.

In this connection, all directly cooled regions or areas in which condensate could collect and form regular pools are especially critical.

For the region of the flue gas collecting chamber especially critical in this respect, the boiler is advantageously so developed that the legs of the U-profiles at least in the area of the flue gas collecting chamber are provided with flag-type extensions. These flags on account of the heat flow in the profile material are rapidly heated up so that condensate forming in this chamber directly gets into contact with these hot extensions and rapidly vaporizes again.

The process of the detrimental condensate formation, furthermore, can be counter-acted in that provided in the area of the wall of the flue gas collecting chamber at the water-facing side is a sleeve on the chamber wall for protection against the water contained in the cooling housing.

An advantageous measure for solving the problem basic to the invention resides in that the combustion chamber is located eccentrically downwardly in the boiler housing preferably formed ovally whereby the water amount in the lower boiler portion to be heated up decreases and can be heated up more rapidly.

Another advantageous embodiment resides in that located ahead of the combustion chamber opening in the reversing chamber is a conventional water-carrying wall in communication with the water-carrying internal space of the boiler housing, with the wall including a central opening for the burner and keeping open the access to the fuel gas flues, on the face of which directed against the combustion chamber opening are mounted horizontally extending U-profiles. These U-profiles may be the same as those forming the flues. They do not require the compression deformation, however.

In the bottom area of the reversing chamber, an additional cup of corrosion-resistant high-grade steel may be provided on the wall defining the chamber.

The boiler according to the invention can be operated at a sliding temperature, i.e. the boiling temperature can be the temperature actually required. At a low heat requirement, the boiler may be operated, for example, at 30° C or even at a lower temperature, with the combustion gases not substantially condensating in the boiler or causing a detrimental corrosion. A boiler having an oil or gas blowpipe which can be operated at a sliding temperature with no substantial dew point corrosion arising or with no detrimental effect of the condensate as formed represents a considerable advantage long desired but never achieved.

The above objects, features and advantages of the present invention will be more fully appreciated by reference to the following detailed description of now preferred embodiments thereof.

BRIEF DESCRIPTION OF THE DRAWING

In the various Figures of the drawing, like reference characters designate like parts.

In the drawing.

Figure 1:
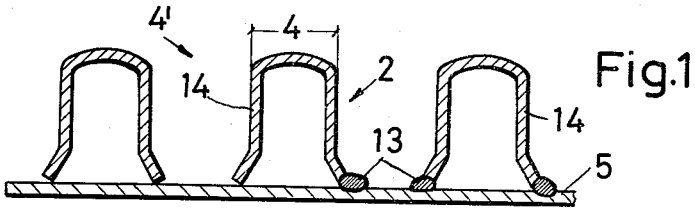
FIG. 1 schematically shows a sectional view of mounted sheet metal profiles prior to their deformation.

Referring to the drawing, 1 designates the longitudinal edges of sheet metal profiles 2; the base regions thereof are designated by 3; 4 refers to the original width thereof and 5 to the internal wall on which sheet metal profiles 2 are mounted and welded. The inserted uncooled, pan-type combustion chamber sleeve preferably of high-grade steel is designated by reference numeral 6; 7 refers to the water-protective sleeve; 8 to the extensions of the profile legs 14; 9 to the water-carrying interior space of the housing 15; 10 refers to the flue gas collecting chamber; 11 to the flue gas discharge and 12 refers to the longitudinal welding seam of the inner wall 5 rounded to form a cylinder.

The sheet metal profiles 2 are preformed, as shown in FIG. 1, and at corresponding intervals are mounted on inner wall 5 which is still planar.

Figure 2:
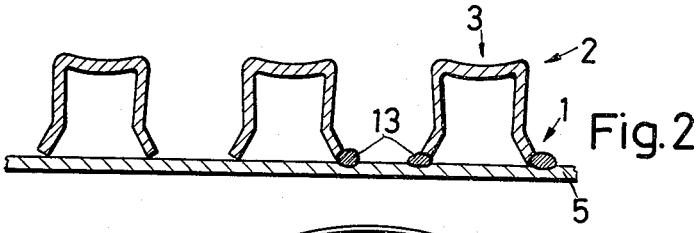
FIG. 2 is a sectional view of mounted sheet metal profiles after the deformation thereof.
Figure 3:
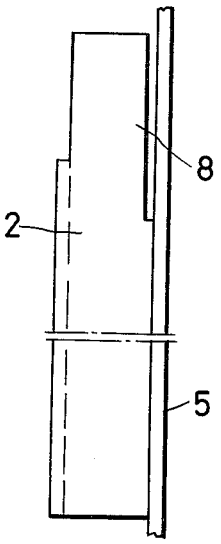
FIG. 3 is a side elevational view of the deformed sheet metal profiles.

As disclosed by FIGS. 1 and 2, longitudinal edges 1 are slightly angular whereby larger space is gained between profiles 2 and longitudinal welding seams 13 under a partial fusion of the leg ends being readily suitable of being laid also mechanically. On account of their relatively large cross section, they form good heat conducting bridges so that the heat from legs 14 can be transferred optimally to the water-cooled inner wall 5.

Concerning the non-water-cooled combustion chamber sleeve 6 (FIGS. 4, 5), it would be unfavorable if sheet metal profiles 2 maintained the shape according to FIG. 1. For this reason, profiles 2 are compressed to a shape according to FIG. 2 whereby cross sections 4' openly directed against combustion chamber sleeve 6 are reduced and the direct contact of discharging flue gases decreases with the sleeve wall. The combustion chamber sleeve 6 is not necessarily pan-shaped in configuration but it is also possible to leave it open at the rear side, with flue gas collecting chamber 10 becoming a reversing chamber and the flue gases flowing through sheet metal profiles 2 from the rear to the front to a glue gas collecting chamber then disposed at the front and provided with a discharge.

Figure 4:
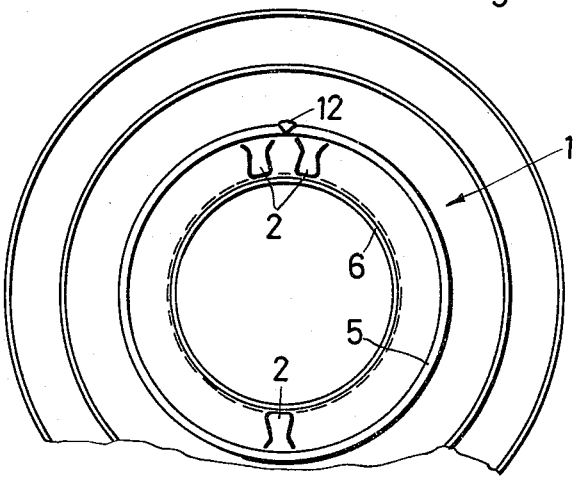
FIG. 4 is a cross sectional view of a boiler provided with the sheet metal profiles.
Figure 6:
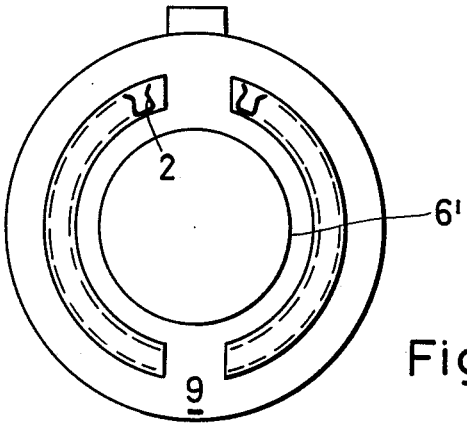
FIG. 6 is a cross sectional view similar to FIG. 4 of a boiler with a water-cooled combustion chamber sleeve.

The boiler formation according to FIG. 6, i.e. provided with a water-cooled combustion chamber sleeve 6' which base webs 3 abut as closely as possible on account of their curvature, has the advantage over the embodiment according to FIG. 4 that the broadened base webs form a larger heat transfer surface relative to the cooled sleeve wall.

Figure 5:
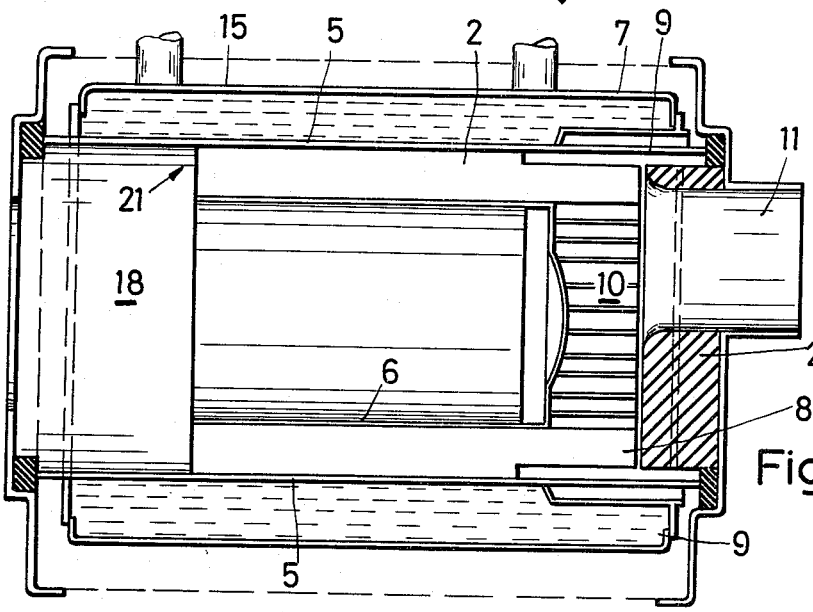
FIG. 5 is a longitudinal section through a boiler according to FIG. 4, provided with the sheet metal profiles, with an uncooled, pan-type, inserted combustion chamber sleeve.
Figure 9:
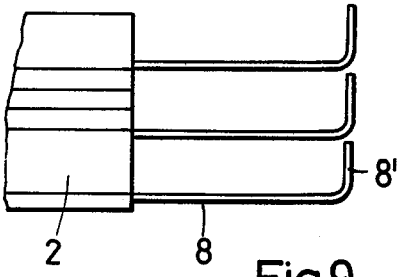
FIG. 9 shows another embodiment of the U-profiles.

In an advantageous embodiment, legs 14 of profiles 2 according to FIGS. 5 and 9 disposed at the discharge side are provided with flag-type extensions 8, thus protruding into the flue gas collecting chamber 10 approximately to the rearward lining 26 thereof, with the ends of the extensions according to FIG. 9 being adapted to be provided with bends 8' in order to be able to mutually support each other against distortions. Such extensions 8, if need be, may also be provided in the area of reversing chamber 18.

In order not to expose the area of the flue gas collecting chamber 10 especially critical as regards the formation of condensate to the cooling action of the water, wall 5 preferably may be provided in this area at the water side with a protective sleeve 7 the interior space of which may be, as shown, open at the rear side. Inasmuch as condensate is formed in this area, it positively gets into contact with extensions 8 rapidly heating up or drips onto the same, quickly vaporizes again and discharges through duct 11.

Figure 7:
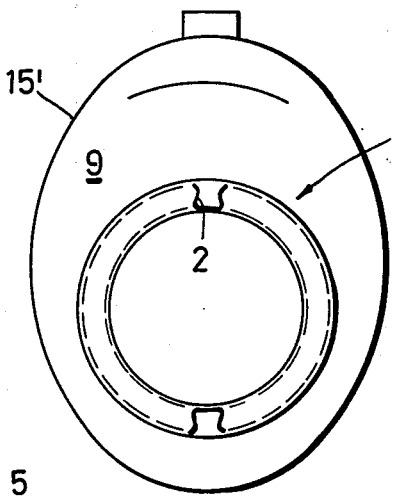
FIG. 7 is a cross sectional view of a boiler in another embodiment.

In order to reduce as much as possible the phase of a condensate formation, it is possible to provide, acccording to FIG. 7, cylindrical chamber 16 eccentrically downwardly in a boiler housing 15', preferably of an oval configuration, thereby reducing the water amount contained in the lower area and thus being heatable more quickly.

Figure 8:
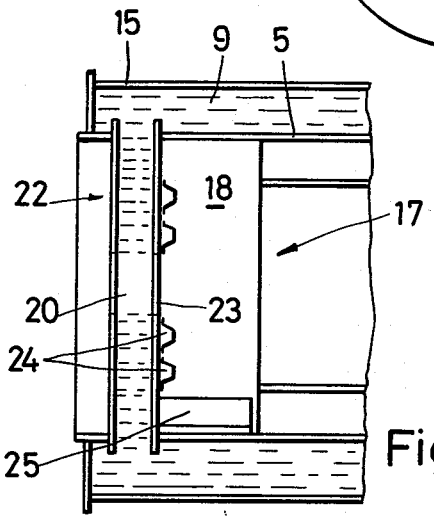
FIG. 8 is a sectional view of the area of the reversing chamber.

Concerning a rapid evaporization of formed condensate, extensions 8 may, as already mentioned, be provided also in the area of reversing chamber 18 (FIG. 8).

The area ahead of the combustion chamber opening 17 through which large amounts of the discharging fuel gases flow, may be provided with a conventional water-carrying wall 22 including an opening 20 for the insertion of the burner (not shown), which at the top and bottom via water-carrying webs, as illustrated in FIG. 8, is in communication with the water-carrying interior space 9 of housing 15.

From web to web, at both sides thereof, an annular gap is formed permitting access to the purging flues if the non-demonstrated closure-lid is opened.

The surface 23 of this wall 22 to which heat is applied is now equally occupied by U-profiles in the horizontal direction which during starting rapidly heat up equally. Rinsing condensate cannot flow downwardly through profiles 24 but rather evaporates on profiles 24 relatively quickly heated up.

In addition to the possibility of providing legs 14 of profiles 2 also in the area of the reversing chamber 13 with extensions 8, as in FIG. 5, a cup 25, preferably of high-grade steel, may be provided in the bottom area of the reversing combustion chamber 18 to prevent corrosion in this area.

What I claim is:

1. A boiler for the combustion of liquid or gaseous fuels, which comprises
   (a) a water-containing jacket housing having an inner wall defining an interior space,
   (b) a cylindrical sleeve defining a fuel combustion chamber arranged in the interior space, and having an open end and a closed end,
   (c) a flue gas reversing chamber in the interior space at the open end of the combustion chamber and in communication therewith to receive flue gas therefrom,
   (d) a flue gas collecting chamber in the interior space at the closed end of the combustion chamber,
   (e) a flue gas discharge in communication with the flue gas collecting chamber for discharging the flue gas from the collecting chamber, and
   (f) a series of circumferentially space U-shaped elongated sheet metal members surrounding the cylindrical fuel combustion chamber and defining flue gas channels for conducting flue gas from the reversing to the collecting chamber, each of the sheet metal members consisting of two legs and a base interconnecting the legs, the legs having outwardly bent longitudinal edges, longitudinally extending seams welding the outwardly bent edges of the legs to the inner wall of the jacket housing, the bases of the elongated sheet metal members being in contact with the cylindrical sleeve, and the members being compressed between the inner wall of the jacket housing and the cylindrical sleeve.

2. The boiler of claim 1, further comprising a protective sleeve surrounding the collecting chamber and protecting the same from water.

3. The boiler of claim 1, wherein the cylindrical sleeve is formed of a planar metal sheet shaped into a tube and having a longitudinally extending seam welding two adjoining edges of the shaped sheet together.

4. The boiler of claim 1, wherein the bases of the elongated sheet metal members conform in shape to the cylindrical sleeve.

5. The boiler of claim 1, wherein the legs of the elongated sheet metal members have extensions reaching into the range of the collecting chamber.

6. The boiler of claim 5, wherein the leg extensions have bent ends projecting towards an adjacent one of the leg extensions.

7. The boiler of claim 1, wherein the jacket housing is oval and the cylindrical sleeve is arranged eccentrically therein.

8. The boiler of claim 1, further comprising a water-containing jacket wall facing the open end of the combustion chamber and spaced therefrom, the reversing chamber being arranged between the open end and the jacket wall, and U-shaped elongated sheet metal members mounted on the jacket wall in the reversing chamber, said members extending in a horizontal direction.

9. The boiler of claim 8, further comprising a cup of corrosion-resistant high-grade steel positioned on the inner wall of the jacket housing at the bottom of the reversing chamber.

* * * * *